United States Patent [19]

Blotenberg

[11] Patent Number: 4,831,534

[45] Date of Patent: May 16, 1989

[54] METHOD AND APPARATUS FOR CONTROLLING TURBOCOMPRESSORS TO PREVENT

[75] Inventor: Wilfried Blotenberg, Dinslaken, Fed. Rep. of Germany

[73] Assignee: Man Gutehoffnungshuette GmbH, Fed. Rep. of Germany

[21] Appl. No.: 936,472

[22] Filed: Nov. 25, 1986

[30] Foreign Application Priority Data

Dec. 18, 1985 [DE] Fed. Rep. of Germany ..... 3544821

[51] Int. Cl.[4] ..... F04D 27/00

[52] U.S. Cl. ..... 364/431.02; 364/571.07; 415/15; 415/1

[58] Field of Search ..... 364/431.02, 494, 571.07; 415/1, 15, 17

[56] References Cited

U.S. PATENT DOCUMENTS

| | | | |
|---|---|---|---|
| 4,090,065 | 5/1978 | Braytenbah et al. | 364/494 |
| 4,139,328 | 2/1979 | Kuper et al. | 415/1 |
| 4,156,578 | 5/1979 | Agar et al. | 415/17 |
| 4,464,720 | 8/1984 | Agarwal | 364/431.02 |
| 4,603,394 | 7/1986 | Bukowski et al. | 364/494 |
| 4,656,589 | 4/1987 | Albers et al. | 364/431.02 |

*Primary Examiner*—Parshotam S. Lall
*Assistant Examiner*—Ellis B. Ramirez
*Attorney, Agent, or Firm*—McGlew & Tuttle

[57] ABSTRACT

When controlling a turbocompressor to prevent pumping there is generated a control signal which controls a blowoff or recycle valve attached to the compressor outlet by continuously monitoring the working point or operating condition coordinates and comparing the coordinates with a blowoff line defined by operating conditions producing a pumping. Upon the occurrence of a pumping surge, a signal is generated which can control for instance the quick opening of the blowoff valve. In addition, according to the invention the signal generated upon the occurrence of a pumping surge is also utilized to initiate a new fixation of the blowoff line or the pumping limit line.

17 Claims, 1 Drawing Sheet

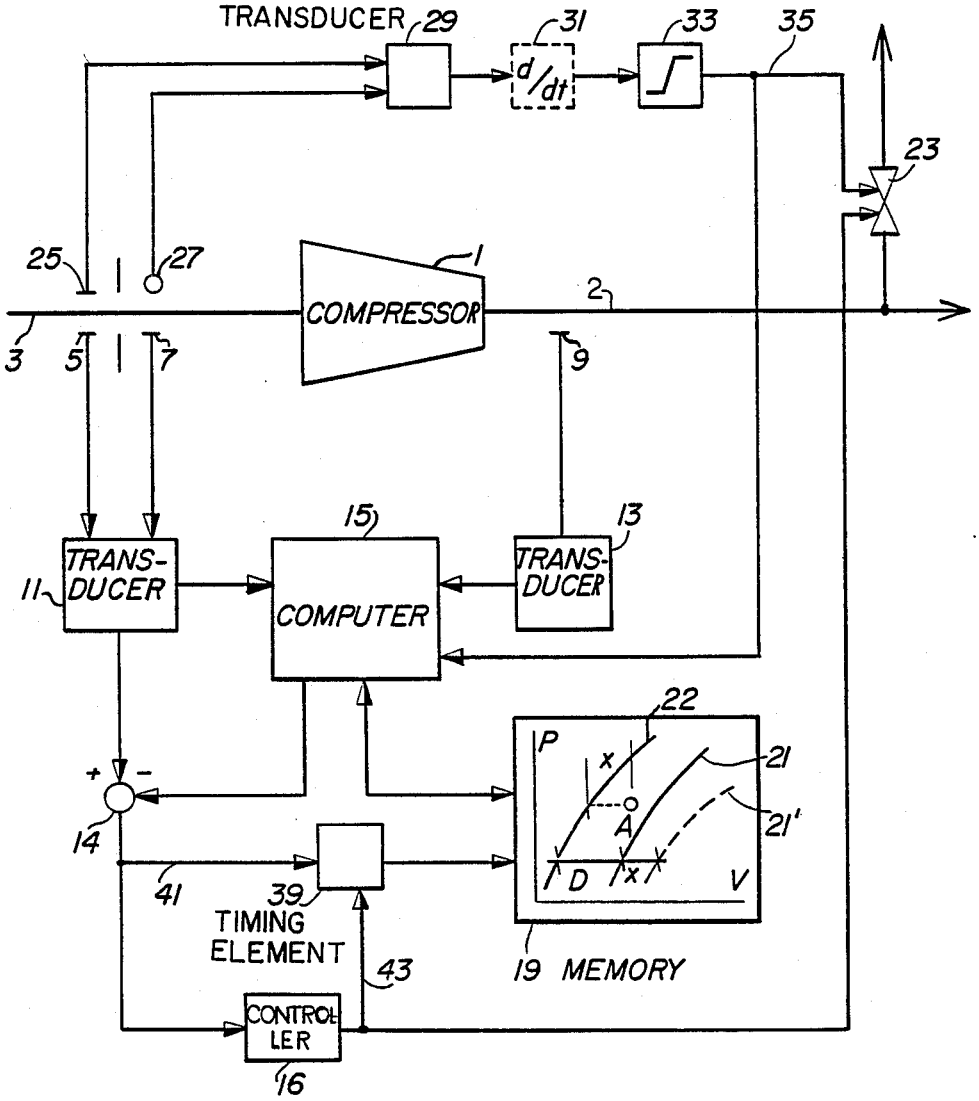
TRANSDUCER
29
31
d/dt
33
35
23
25
27
1
COMPRESSOR
2
3
5
7
9
15
13
TRANS-
DUCER
11
TRANS-
DUCER
COMPUTER
22
P
21
21'
A
D
V
+
-
14
41
39
TIMING
ELEMENT
43
19 MEMORY
CONTROL
LER
16

METHOD AND APPARATUS FOR CONTROLLING TURBOCOMPRESSORS TO PREVENT

FIELD AND BACKGROUND OF THE INVENTION

This invention relates in general to compressors and in particular to a new and useful apparatus and method for controlling an operation of a turbocompressor so as to prevent pumping or surging.

In turbocompressors, surging or pumping is a process in which feed medium flows in surges from the compression side back to the suctions side. Pumping sets in when the pressure ratio between end pressure and suction pressure is too high or the throughput is too low. A so-called pumping limit line on a curve which separates the stable working range from the instable range in which pumping occurs can be defined in the pressure throughput characteristic field. To control the compressor so as to avoid pumping, a blow-off line of the compressor is preset in the characteristic field which runs parallel to the pumping limit line at a safety distance. If the momentary working point of the compressor approaches the blow-off line, a blow-off or recycle valve branched of the compressor outlet line is opened to lower the end pressure or increase the throughput. Such a pumping limit control is known from the article by Blotenberg "Turbolog- The Electronic Control System for GHH Turbomachines" in Nachrichten fur den Maschinenbau (News for Machine Builders) No. 3, May '82 as well as from German AS No. 26 23 899 and the U.S. Pat. Nos. 4,142,838 and 4,386,142.

The procedure in such pumping limit controls has so far been to measure the pumping limit of the compressor when starting initially and, based on this measurement, to preset the blow-off line at a preselected safety distance from the pumping limit line. Therefore, the shape of the blow-off line is based on the shape of the pumping limit line measured at acceptance or commissioning. Usually, however, acceptance tests are run under different marginal conditions than prevail in operation in practice, e.g. regarding the dynamics of working point shifts in the characteristic field. If the working point shifts quickly in the direction towards the instable range, pumping surge will occurr in some compressors sooner than when the working point changes slowly. This means that a pumping limit line measured under acceptance conditions with slow working point changes may be too far to the left in the characteristic field for operation in practice. Furthermore, the actual pumping limit line may vary as the hours of compressor operation increase, e.g. by contamination, zero shifting of a transducer or drift of the measuring range. Different feed medium compositions also may have an effect on the location of the pumping limit line.

All these uncertanties and inaccuracies must be taken into account when determining the safety distance between the blow-off line and the pumping limit line. This often leads to an unnecessarily great safety distance, i.e. to an unnecessarily frequent response of the pumping limit control and opening of the blow-off valve without the danger of pumping being present. This causes undesired blow-off losses.

On the other hand, if the safety distance is made too narrow, it may happen in later operation that the blow-off line runs too close to the pumping limit line and that the pumping limit control does not respond in time to prevent, by opening the blow-off valve, that the pumping limit is reached and frequent pumping surges occur.

SUMMARY OF THE INVENTION

The invention provides a device and a method in which information on the actual course of the pumping limit line is obtained during continuous operation and the blow-off line can be matched accordingly.

Accordingly, the method according to the invention works by the principle that, for every pumping limit control, the associated characteristic field coordinates are acquired and used as criterion for the actual course of the pumping limit line. If it turns out that such a pumping surge occurs at a working point not located on the originally measured pumping limit line, an appropriate newcourse of the pumping limit line is determined and the course of the blow-off line is corrected accordingly. This affords the advantage that the course of the blow-off line is always adapted to the actually valid pumping limit line. Therefore, one can also work with a relatively narrow safety distance between blow-off line and pumping limit line.

In accordance with the method of the invention, the control of a turbocompressor is accomplished by the control of a blow-off valve in response to the operating conditions sensed at either the inlet or outlet of the compressor or both and sent to a computer which has a memory defining a blow-off condition limits so that a control signal generated by the computer and a controller of the blow-off valve to cause operation of the blow-off valve to prevent pumping or surge.

In accordance with the invention, the coordinates for the memory of the computer are further varied in accordance with actual surge conditions which are encountered so that a further operation or correction is effected on the blow-off valve to avoid pumping surge.

Accordingly it is an object of the invention to provide an improved method of controlling a compressor.

A further object of the invention is to provide a compressor which has an inlet and a discharge with a blow-off valve at the discharge which is regulated by a computer which is fed with operating condition information sensed from the compressor at the inlet and discharge and which has a memory with limit line showing when operating conditions are such which are likely to produce turbocompressor surge so that the computer will operate the blow-off valve to avoid surge and which further includes means for sensing when actual surge conditions do occur so that the memory is varied in accordance therewith.

A further object of the invention is to provide apparatus for controlling a compressor which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

The only FIGURE of the drawings is a schematic representation of the device constructed in accordance with the invention.

DESCRIPTION OF THE PREFERRED EMBODIMENT

Referring to the drawing in particular the invention embodied therein comprises a compressor 1 having an inlet 3 and a discharge 2. There are provided spaced sensor elements 5 and 7 at the inlet and a sensor 9 at the outlet connected to transducers 11 and 13 which connect to a computer 15 so as to provide operating information to the computer 15. The computer 15 in turn has a memory 19 with a blow-off curve 21 and surge line 22 thereon indicating operating condition of the compressor 1 which would be likely to produce pumping or surge. In the inventive arrangement, further means are connected to the computer 15 and memory 19 to ensure that the operating conditions showing when pumping occurs are corrected by conditions which actually do turbocompressor surge of the compressor and which are detected by the sensing means which are connected to the computer 15.

In the suction nipple or inlet 3 of a compressor 1 a suitable measuring arrangement measures the compressor throughput or volumetric flow V by means of the signal formers or sensors 5, 7 and possibly also the suction pressure and suction temperature. The pressure sensor 9 acquires the end pressure at the compressor outlet or discharge 2. Through appropiate transducers 11, 13 these actual values reach a computer 15 which compares these values, which represent the characteristic field coordinates of the working point in the compressor characteristic field defined by throughput and end pressure (possibly also the ratio of the end pressure to the suction pressure ratio or variation thereof), with the course of a blow-off line 21 in the characteristic field as stored in a memory 19.

From the actual value for P (not defined) the computer 15 computes by way of the blow-off line a setpoint for V which is compared with the actual value for V in a subtractor 14. The difference is put as control signal into a controller 16 which generates a corresponding positioning signal for a blow-off valve 23 branched off the compressor outlet.

Also provided is a device for the acquisition of pumping information. Pumping surges can be acquired by monitoring the variation of various operating variables such as the end pressure, the volumetric flow aspired, the suction temperature, the power output, or input of the driver, the speed, the bearing temperature of the thrust bearing, the axial shift of the impeller shaft, etc.

Upon commissioning a new compressor or upon initial use of the new compressor 1, coordinates of pressure and volumetric flow are stored in memory 19 with regard to surge of the particular turbocompressor 1. This surge limit line is shown as surge limit line 22 in FIG. 1.

In the embodiment shown, the information of pumping surge is acquired by monitoring the rate at which the suction flow signal changes. In the event of a pumping surge the flow breaks off at the compressor blades. A sudden reversal of the flow direction takes place. This means that the suction flow is reduced in the shortest period of time, much faster than the process could make a flow change possible. The occurrence of such a rapid flow change could be determined, for instance by differentiating or comparing two signals spaced a fixed time interval apart. For this purpose, the suction flow is determined either by the signal formers 5, 7 or preferably, as shown by a suitable flow metering arrangement with the sensors 25 and 27 and the transducer 29, which arrangement is independent of the flow metering arrangement of the pumping limit control, and differentiated in the differentiator 31. The flow signal change rate thus obtained is fed to the comparator 33 which compares the values with present limited values, and if the limital values are exceeded, generates a signal which indicates a pumping surge and can serve the quick emergency opening at the blow-off valve via a line 35, for instance.

The signal indicating the pumping surge is also fed to the computer 15 where it causes the momentarily present characteristic field coordinates $\dot{V}$, P of the working point to be compared with the surge limit line 22 stored in the memory 19. If the location of this working point A deviates from the originally present surge limit line 22, e.g. by the abscissa amount X, the blow-off line 21 will be corrected accordingly also, e.g. in the simplest case shifted by the same amount X parallel to the right so that a new blow-off line 21' with appropriate safety distance from the actual (newley found) pumping or surge limit line is obtained.

Furthermore, the acquisition of the pumping surge can be made more reliable in that the characteristic field coordinate $\dot{V}$, P of the working point or their change rate are acquired also in the computer 15 or by a differentiator (not shown) and in that the pumping limit line or blow-off line are corrected only when, in addition to the pumping surge signal acquired by the arrangement described above, other criteria are met which allow a plausibility check to be made. Such criteria are, for instance, a suction temperature rise directly ahead of the first impeller, a variation of the compressor and signal or other variable (axial shifting of the shaft, temperature of the thrust bearing, variation of power or speed).

The correction of the surge limit line and or blow-off line by way of the sensed pumping surges can also be refined. For example, the pumping limit line can be plotted as polygonal progression through the working points of several measured surge points.

If these measurements are taken at a longer time interval it may happen that the pumping limit line has a zig-zag shape. The same result can come about in the event of errors in the measuring arrangement. Therefore, it can be determined in another circuit whether the pumping limit line contains individual freak values in that e.g. the gradients of the various sections of the polygonal progression are compared to each other. It is known, for instance, that the pumping limit line becomes flatter and flatter with increasing compression ratios. If a comparison of the gradients shows, for instance, that the pumping limit becomes steeper again in a partial section with rising pressure, a correction is required. This can be accomplished for example, by neglecting the older of the two corner points and by forming a new polygonal progression.

Should this not be desirable, the new value may not be taken into account. It is understood that certain tolerance thresholds for the gradient are accepted. For example, the circuit may operate so that a plausibility check as described above is made only if gradient changes or deviations of e.g. several percent are measured. If the check of the pumping limit shows that the newly measured pumping point is on the known pumping limit or even to the left of it, this is an indication that the set safety distance between pumping limit and blow-off line is insufficient. Otherwise, the control would have prevented the pumping surge. The reason for this could be, for instance, a wrongly adjusted pumping limit controller or too slow a blow-off valve. In the event of such a malfunction it is necessary to increase the safety distance. This is done most logically by adding a present increment to the effective distance.

The measured pumping or surge limit can be graphically displayed on a plotter, a new plot appearing after each new pumping surge. Of course, all data can also be put into a malfunction reporting printer or into a storage system (digital or analog).

A signal, e.g. in the form of an alarm, should be emitted upon each automatic change of a parameter.

Another plausibility check posibility is monitoring the working point change rate, e.g. with a second limited value. A detached cable on a pressure transducer, for instance, leads to a very rapid working point change which is much faster even than any actual process point change upon a pumping surge. Therefore, whenever a signal indicating a pumping surge appears, it can be determined whether the change rate of the working point also corresponds to a pumping or surge behavior or whether an equipmental malfunction must be assumed. A pumping surge signal based on equipment malfunction, of course, is not processed further.

A working point change can also be determined, for instance, by observing the control differene of the pumping limit controller.

Another important aspect must be watched when different sensors, transmission paths or evaluating circuits for the pumping limit control and the pumping surge acquisition are used. In this case it is recommended to check plausibility by finding out whether both systems acquire the same change. For example, if the pumping surge acquisition system acquires a pumping surge without the control noticing a working point change, then there is either a measuring error or a total control failure. There is signal emission, but no pumping limit adjustment.

It was assumed in the above description that the safety distance D between the pumping limit line 22 and the blow-off line 21 is preset and constant. However, in a particularly advantageous further development of the invention it is also possible to work with a variable safety distance D. The compressor blow-off losses can thereby be reduced without a substantial safety loss. A timing element 39 is provided for this purpose which, during the operation of the compressor, furnishes pulses to the memory 19 (or to the computer 15) in time intervals. These signals trigger in the memory 19 a continual reduction of the safety distance D as long as there is no pumping surge. This brings the blow-off line 21 closer and closer to the momentarily valid pumping limit line 22, which means that the blow-off valve 23 closes more and more. When the compressor operates within its design range, the blow-off valve is closed and stays that way. As the blow-off line continues to approach the pumping limit line, however, the occurrence of a pumping surge becomes more and more probable as the compressor working point nears the blow-off line. In the event of a pumping surge, it is not only the course of the pumping limit line which is checked and possibly corrected by way of the working point coordinates acquired during the pumping surge, the safety distance D is readjusted to a greater, new value in addition. This greater, new value may be the former initial value. Preferably, however, the safety distance D is adjusted upon each pumping surge to a new value computed in relation to the actual to set-point difference of the characteristic field coordinate $\dot{V}$ present during the pumping surge, i.e. of the throughput on the suction side. In particular, the new safety distance D value should be equal to or greater than this actual to set-point difference present at the instant of the pumping surge.

In further development, the timing element 39 receives the control difference signal from the subtractor 14 via a line 41 or the output signal of the controller 16 via a line 43. This opens up the possibility of activiating the timing element 39 only when the momentary working point is on or the left of the blow-off line 21. This is indicated in that the control difference signal of the subtractor 14 is positive and/or in that the output signal of the controller 16 has a value effecting the opening of the blow off valve 23. The effect of this arrangement is that the safety distance D is reduced only when the compressor is operated in a working range in which a pumping surge may occur also. It makes sense, therefore, to effect the continuous reduction of the safety distance D controlled by the timing element 39 only during such operating conditions. If the working point is far to the right of the blow-off line 21 during most of the operating time, i.e. if the blow-off valve is completely closed, a reduction of the safety distance D serves no purpose because if the working point approaches the blow-off line 21 again, the latter could possibly have come too close to the pumping limit line 22 already. The timing element may, of course, also be activated or deactivated by other criteria or manually. For example, an arrangement is realizable where the timing element 39 is activated only by an external command from the operator. This makes it possible to check the pumping limit location intentionally and regularly.

As mentioned above, it is advantageous to acquire in the computer 15 also the change rate of the working point coordinates, for instance in order to evaluate by way of the change rate whether, for instance, a signal furnished by the comparator 33 actually indicates a pumping surge or possibly is based on a malfunction. In addition to such a plausibility check, however, the change rate of the working point coordinates acquired in the computer 15 (or outside of the computer, e.g. by means of differentiators) can also be utilized for a correction of the new fixation of the pumping limit line 22 made upon each pumping surge. Due to the different inertias of the systems acquiring the working point coordinates (e.g. pressure sensors 5, 7, 9 and the connected processing circuits) and also the system serving the acquisition of the pumping surge it may happen that, at the instant a pumping surge is indicated, working point coordinates are acquired that are not the ones present at the exact time of the pumping surge. By way of the change rate of the coordinate values acquired in addition to the latter, it is possible to carry out in the computer 15, by way of correction values taking into account the different inertias of the systems, a correction of the working point coordinates used to redefine the pumping limit line 22 in the memory 19. This happens if there is a delay in the sensor system.

Digital computer circuits have the disadvantage that they interrogate the input signals cyclically only so that a time delay originates which manifests itself as measuring error when the working point changes are rapid.

It is advisable in such arrangements to use as working point at the time of the pumping surge measured values one or more scanning cycles ahead of the acquisition of the pumping surge.

While a specific embodiment of the invention has been shown and described in detail to illustrate the application of the principles of the invention, it will be understood that the invention may be embodied otherwise without departing from such principles.

What is claimed is:

1. A method of controlling the operation of a turbocompressor having an inlet and an outlet line with a blow-off valve, at least one sensor at the inlet and at least one sensor at the outlet, the turbocompressor having a characteristic field of operation based on a relationship between one or more operating variables including at least a controlled variable and a command variable of the turbocompressor, the turbocompressor operating at an operating point in the characteristic field, an initial surge limit line lying in the characteristic field based on surge of the turbocompressor during initial trial use, a blowoff line lying in the characteristic field spaced from the initial surge limit line by a safety distance, the blowoff line representing a predetermined relationship between operating variables, comprising the steps of: generating an input signal from a continuously acquired actual value of at least one operating variable of the turbocompressor providing an actual command variable signal; comparing said input signal, actual command variable with the blow-off curve stored as data in a memory, and forming a set point signal representing a set point for a controlled variable based on the position of the actual command variable with respect to the blow-off curve; formulating a positioning signal based on the difference between the set point controlled variable set point signal and actual controlled variable of the turbocompressor; receiving said positioning signal in a controller and generating a control output signal for opening and closing the blow off valve; detecting a surge of the turbocompressor based on an actual value of an operating variable; upon the occurrence of detecting the surge, storing the actual value of at least one of the operating variables in a memory and forming a new blow-off line based on the position of the surge operating variables in the characteristic field.

2. A method according to claim 1, wherein the new blow-off line is formed so that it is always at a constant distance from a surge limit line going through the sensed operating variables of the pumping surge measured last.

3. A method according to claim 1, wherein the new blow-off line is formed so that it runs at a constant presettable distance from a surge limit line determined by the computer from the operating values of operating points of a plurality of acquired pumping surges.

4. A method according to claim 1, wherein the last pumping surges are taken into account and the oldest pumping surge is neglected in respect to forming a new the blow-off line.

5. A method according to claim 1, wherein detecting the turbocompressor surge by monitoring an operating parameter such as temperature, compressor end pressure, power output or speed, a plausibility check is made by comparison with sensed coordinates of the momentary operating point and their rate of change.

6. A method according to claim 1, wherein in addition to the characteristic field coordinates, the change rate of at least one operating variable is also acquired and the working point coordinate belonging to a pumping surge are corrected additionally by the change rate in a manner such that the different inertias of the system acquiring the pumping surge and the working point coordinates are compensated.

7. A method according to claim 1, wherein upon each occurrence of a turbocimpressor surge a readjustment of the safety distance between the blow-off line and the pumping limit line going through the working point belonging to the pumping surge is also made.

8. A method according to claim 7, wherein the safety distance between the surge limit line and blow-off line is continuously decreased from an initial value during the operation of the compressor and upon the occurrence of a turbocompressor surge a greater new safety distance is re-established.

9. A method according to claim 8, wherein the safety distance value is reduced continuously only in those operating states of the compressor in which the working point is close to the blow-off line.

10. A method according to claim 8, wherein the new safety distance value is adjusted as a function of the difference present during the pumpng surge between the actual value and set point value of the operating condition coordinate.

11. A device according to claim 8, wherein the safety distance is reduced continuously only in those operating states of the compressor in which the working point is on the blow-off line.

12. A device according to claim 11, wherein the safety distance is reduced continuously only in those operating states of the compressor in which the working point is above the blow-off line.

13. An apparatus for controlling the operation of a turbocompressor having a discharge with a blow-off valve which is controllable, comprising first sensing means connected to the inlet of said turbocompressors, second sensing means connected to the outlet of said compressor, a computer connected to each of said first and second sensing means and having a memory in which curves representing conditions at which the blow-off valve should be operated so as to prevent turbocompressor surge, a control means connected to said computer and to said blow-off valve for operating said blow-off valve, said first and second sensors comprising controlled variable and command variable sensors, signal formers connected to said sensors to acquire the characteristic field coordinates of momentary working points and feeding it to the computer, said computer memory having a surge limit line defined in the characteristic field and a blow-off line running at a safety distance therefrom adjustably preset, a comparator connected to said computer to compare the monitored actual value with the set point value of at least one characteristic field coordinate preset by the computer memory by comparison with the blow-off line, the output signal of the comparat or being applied to the controller to control the blow-off valve, and a device for the acquisition of an operating stage of the compressor occurring upon a pumping surge for the generation of a signal indicating the pumping surge connected to said computer, said signal indicating the pumping surge being fed to the computer memory as a correction signal to change the blow-off line.

14. A device according to claim 13, including a timing element arranged outside of the computer which generates at time intervals a signal which trigger a reduction of the safety distance between the blow-off line and the pumping limit line in the computer memory.

15. A device according to claim 14, wherein the timing element is deactivatable and activatable as a function of a signal coordinator with the difference between the actual value and set point value of a working point coordinate of the controller output signal.

16. An apparatus for controlling the operation of a turbocompressor having an intake line and a discharge line with a blow-off valve, the turbocompressor having a characteristic field of operation based on a relationship between operating variables, comprising: first sensor means positioned at said intake line for generating a first sensor signal representative of an actual intake operating variable of said turbocompressor; said second means positioned at said discharge line for generating a second sensor signal representative of an actual discharge operating variable of said turbocompressor; memory means for storing a surge limit line as data, based on sensed operating variables of the turbocompressor during an initially detected turbocompressor surge and for storing a blowoff line as data based on a predetermined relationship between operating variables of the turbocompressor, the blowoff line being spaced from said surge limit line by a safety distance in the characteristic field of operation; computer means for receiving said second sensor signal and accessing blow-off line data in said memory to form a set point value representative of a blowoff line set point operating variable which corresponds to the discharge operating variable sensed; subtractor means for comparing said set point signal with said first sensor signal to formulate a positioning signal representative of the difference between said set point signal and said first sensor signal; control means for receiving said positioning signal and outputting a control signal for operation of the blow-off valve; surge detection means for receiving one of said first and second sensor signals as a surge operating variable and for generating a signal indicating pumping surge which is representative of the value of the surge operating variables; said computer means receiving said signal indicating surge, said computer means including means for comparing said signal indicating surge with said surge limit line stored in said memory to determine if the value of the surge operating variables deviates from the value of the operating variables forming the surge limit line and for forming a new blow-off line and storing the newly formed blow-off line in the memory means based on the deviation of the surge operating variables from the surge limit line.

17. An apparatus for controlling the operation of a turbocompressor according to claim 16, wherein: said surge detection means includes a differentiator receiving said sensor signal representative of the volumetric flow rate of the turbocompressor and forming a signal representing the rate of change of the volumetric flow rate and a comparator for comparing the rate of change of the volumetric flow rate of the turbocompressor with a preset limit value to generate said signal indicating pumping surge.

* * * * *